United States Patent [19]

Christy

[11] Patent Number: 4,846,406

[45] Date of Patent: Jul. 11, 1989

[54] MICRO FLOW CONTROL VALVE FOR IRRIGATION SYSTEMS AND METHOD

[75] Inventor: Mark H. Christy, Balboa, Calif.

[73] Assignee: Wade Manufacturing Co., Portland, Oreg.

[21] Appl. No.: 128,880

[22] Filed: Dec. 4, 1987

[51] Int. Cl.[4] ..... B05B 15/00

[52] U.S. Cl. ..... 239/542; 239/276

[58] Field of Search ..... 239/533.1, 533.13, 533.14, 239/542, 547; 138/46

[56] References Cited

U.S. PATENT DOCUMENTS

| | | | |
|---|---|---|---|
| Re. 29,022 | 11/1976 | Spencer | 239/542 |
| B 570,382 | 4/1976 | Spencer | 239/288.3 |
| 2,554,790 | 5/1951 | Miller | 138/43 |
| 2,781,061 | 2/1957 | Frey . | |
| 3,409,050 | 11/1968 | Weese | 138/46 X |
| 3,685,735 | 8/1972 | Foster | 239/109 |
| 3,779,468 | 12/1973 | Spencer | 239/542 |
| 3,797,741 | 3/1974 | Spencer | 239/11 |
| 3,797,754 | 3/1974 | Spencer | 239/542 |
| 3,814,377 | 6/1974 | Todd | 251/145 |
| 3,815,636 | 6/1974 | Menzel | 138/43 |
| 4,023,595 | 5/1977 | Zakay | 138/45 |
| 4,058,257 | 11/1977 | Spencer | 239/542 X |
| 4,095,745 | 6/1978 | Christy | 239/109 |
| 4,113,180 | 9/1978 | Christy et al. | 239/542 X |
| 4,132,364 | 1/1979 | Harmony | 239/533.13 X |
| 4,190,206 | 2/1980 | Atkinson et al. | 239/271 |
| 4,193,545 | 3/1980 | Haoens | 239/547 X |
| 4,502,631 | 3/1985 | Christen | 239/106 |
| 4,519,546 | 5/1985 | Gorney et al. | 239/542 |
| 4,550,878 | 11/1985 | Rosenberg | 239/542 |
| 4,589,595 | 5/1986 | Havens | 239/271 |
| 4,593,857 | 6/1986 | Raz | 239/109 |

FOREIGN PATENT DOCUMENTS 2078478 1/1982 United Kingdom .

OTHER PUBLICATIONS

ASAE Publication dated Nov., 1985 (pp. 318–324).

*Primary Examiner*—Andres Kashnikow
*Assistant Examiner*—Kevin P. Weldon
*Attorney, Agent, or Firm*—Phillips, Moore, Lempio & Finley

[57] ABSTRACT

A micro flow control valve is interconnected between a main water line and a water distributing device, such as a mini sprayer. The interchangeable flow control valve is adapted to maintain a predetermined near constant micro flow rate of water to the distributing device within the approximate range of from 2.0 gph to 60.0 gph despite fluctuations in water pressure in the main water line. The control valve comprises a pin having at least one open-top channel defined at an outer surface thereof and a flexible diaphragm at least partially covering the channel. In operation, main line water pressure communicated to the control valve will function to flex the diaphragm into the channel to maintain such predetermined near constant micro flow rate in response to a variable pressure differential produced across the diaphragm. In carrying forth the method steps of this invention, the control valve can be removed from a housing and replaced with a second micro flow control valve having different flow rate characteristics. The second control valve will function to maintain a predetermined near constant second micro flow rate at an outlet thereof that is different from the first-mentioned micro flow rate.

28 Claims, 3 Drawing Sheets

FIGURE 6
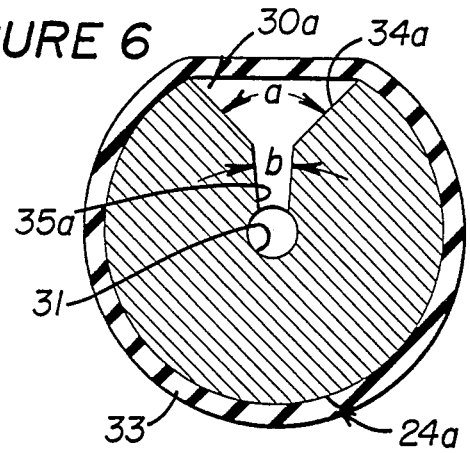
FIGURE 7
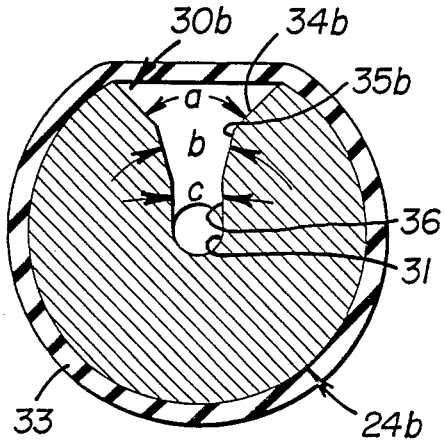
FIGURE 8
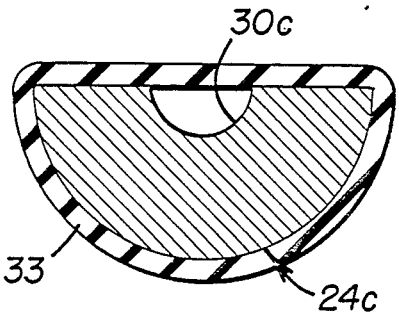
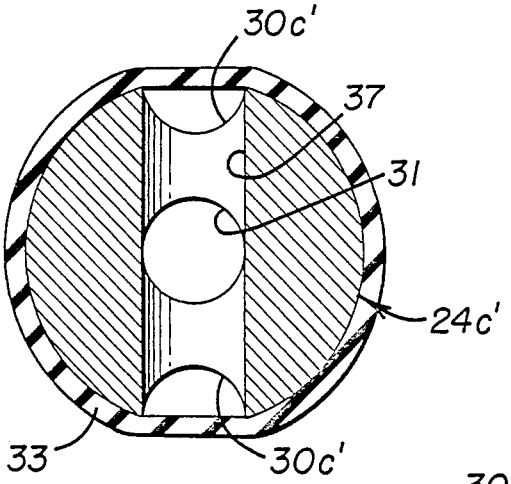
FIGURE 9
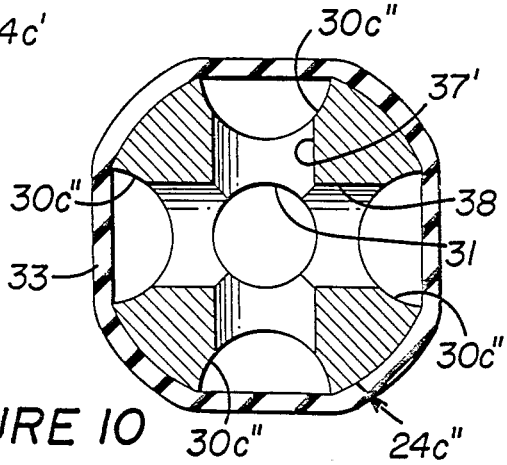
FIGURE 10

MICRO FLOW CONTROL VALVE FOR IRRIGATION SYSTEMS AND METHOD

TECHNICAL FIELD

This invention relates to a flow control valve for controlling the flow rate of water to a water distributing device and more particularly to a micro flow control valve for maintaining the flow rate of water distributed from a garden or agricultural sprinkler system substantially constant.

BACKGROUND OF THE INVENTION

The advent of "micro" irrigation systems (e.g., rated at from 2.0 gph to 60.0 gph) for garden and related agricultural uses has given rise to the need for a flow control valve that will communicate a near constant flow rate to a water distributing device, such as a mini sprayer. Systems of this type include a main water line composed of a plastic tube and a series of spaced smaller plastic tubes or branch lines interconnected between the main water line and each water distributing device. In addition to the problem of not providing a substantially constant flow rate of water to the distributing devices, systems of this type are prone to clogging.

Various pressure-compensating flow control valves have been proposed for solving the above enumerated problems in the field of irrigation, such as for drip or trickle irrigation systems. For example, Applicant's U.S. Pat. No. Re. 29,022 discloses various embodiments of a self-flushing and pressure compensating irrigation valve that will function to maintain a predetermined near constant flow rate of water at the outlets of an irrigation system in response to fluctuations of main line water pressure. Although valves of this type work quite well for drip or trickle type irrigation systems, there is a further need for providing a similar valve for irrigation systems wherein water is periodically communicated to water distributing devices, such as mini sprayers having flow rates in the range of from 2 gph to 60 gph.

SUMMARY OF THE INVENTION

An object of this invention is to provide an improved micro flow control valve and method for communicating water to a water distributing device at a predetermined, near constant micro flow rate within the approximate overall maximum range of from 2.0 gph to 60.0 gph and, more preferably, within the maximum range of from 2.0 gph to 30.0 gph., in response to fluctuations in main water line pressure.

In one aspect of this invention, the micro flow control valve comprises a body element or pin having an inlet and an outlet, at least one open-top channel defined at an outer surface of the pin for intercommunicating mainline water pressure from the inlet to the outlet, and a flexible diaphragm at least partially covering the channel for flexing into and cooperating with the channel to maintain the flow rate of water at the outlet of the control valve at a predetermined near constant micro flow rate in response to a differential in water pressure produced between the channel and externally of the diaphragm.

In another aspect of this invention, the pin and flexible diaphragm are disposed in an inlet chamber of a housing to expose the diaphragm to a variable main line water pressure and the outlet of the control valve is connected to a water distributing device, such as a sprayer, forming part of an integrated irrigation system for garden and related agricultural uses.

In another aspect of this invention, a method for selectively changing the controlled near constant micro flow rate of the water in the irrigation system comprises the steps of removing the above control valve from the inlet chamber of the housing and replacing it with a second micro flow control valve having flow rate characteristics different from that of the replaced control valve to maintain a predetermined near constant second micro flow rate at an outlet of the second control valve that is different from the first micro flow rate.

This invention materially enhances the quality of the environment by contributing to the maintenance of basic life-sustaining material elements, namely, water, soil and fertilizers by maintaining a substantially constant flow rate of water from water distributing devices employed in irrigation systems.

BRIEF DESCRIPTION OF THE DRAWINGS

Other objects and advantages of this invention will become apparent from the following description and accompanying drawings wherein:

FIGS. 6–10 are cross-sectional views, similar to FIG. 4, illustrating modifications of a flow channel employed in the micro flow control valve.

DESCRIPTION OF THE PREFERRED EMBODIMENTS

General Description

Figure 1:
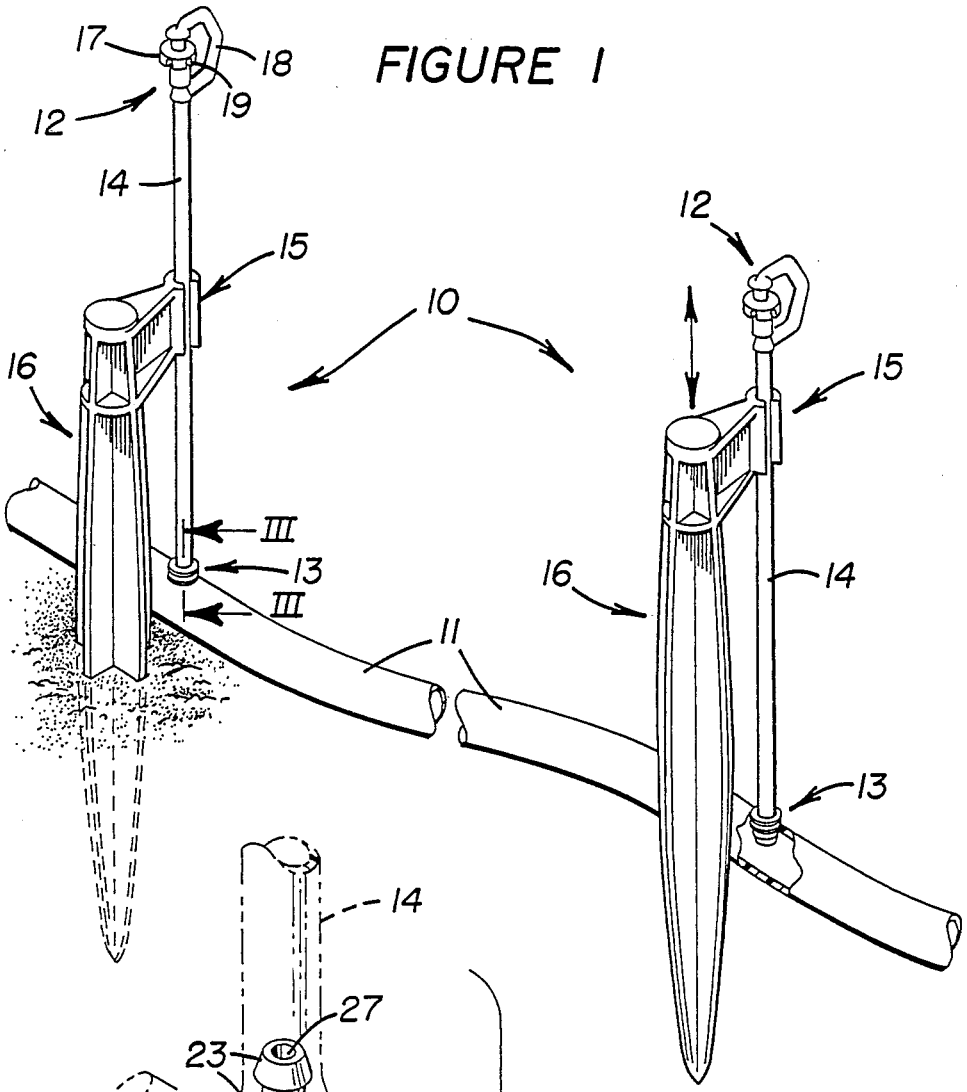
FIG. 1 illustrates an irrigation system including a micro flow control valve embodiment of this invention adapted to communicate water to a water distributing device at a near constant micro flow rate.
Figure 2:
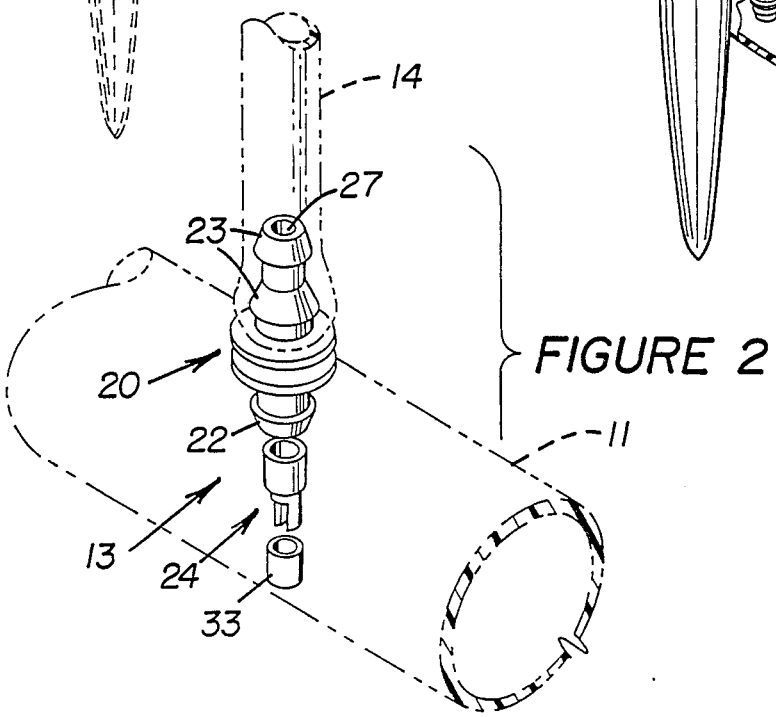
FIG. 2 is an exploded isometric view of the control valve prior to the assembly of component parts thereof.

FIG. 1 partially illustrates an integrated irrigation system 10 comprising a main water line or tube 11 for supplying water at a variable pressure level within the approximate range of from 10 psi to 60 psi to a plurality of water distributing devices, shown in the form of mini-sprayers 12. In certain irrigation systems, the water is admixed with sulfuric acid, chlorine, fertilizers or the like in a conventional manner. A micro flow control valve 13, embodying this invention, is interconnected between the main water line and a respective branch line or tube 14 having sprayer 12 suitably connected to an upper end thereof. The tube is adjustably mounted in semi-tight slip-fit relationship within a bracket 15, extending transversely from an upper end of a support stake 16, whereby the sprayer can be adjusted vertically relative to the stake and ground level.

As described more fully hereinafter, water communicated to sprayer 13 from control valve 13 is maintained at a predetermined near constant micro flow rate selected from within the approximate overall maximum range of from 2.0 gph to 60.0 gph and more commonly from within the range of from 2.0 gph to 30.0 gph. Such near constant micro flow rate will be maintained despite fluctuations in water pressure communicated to an inlet of the control valve from main water line II. As further described hereinafter, the control valve is self-purging to prevent foreign particle build-up therein which might affect its operation.

Other types of water distributing devices, such as drippers or emitters, can be substituted in lieu of sprayer 12 with suitable modification. The conventional sprayer illustrated comprises an annular head 17 rotatably mounted within a C-shaped support arm 18 and having a pair of diametrically opposed and vertically disposed slots 19 defined externally thereon. The slots are inclined slightly relative to the longitudinal axis of head 17 whereby pressurized water emitted from the outlet end of tube will impinge within the slots and rotate the head to distribute the water in spray-like fashion.

Detailed Description

Referring to FIGS. 2–5, micro flow control valve 13 comprises a tubular housing 20 defining a water-receiving cylindrical chamber 21 at the inlet to the valve, adapted to receive water from main water line 11 at a working pressure level within the approximate range of from 10 psi to 60 psi. One or more annular barbs 22 are formed externally at the inlet end of the housing for the purpose of piercing main water line 11 in a conventional manner to anchor and seal the control valve thereat. One or more similar barbs 23 are formed at the outlet end of the housing for attaching and sealing the inlet end of tube 14 thereat in a conventional manner.

Figure 3:
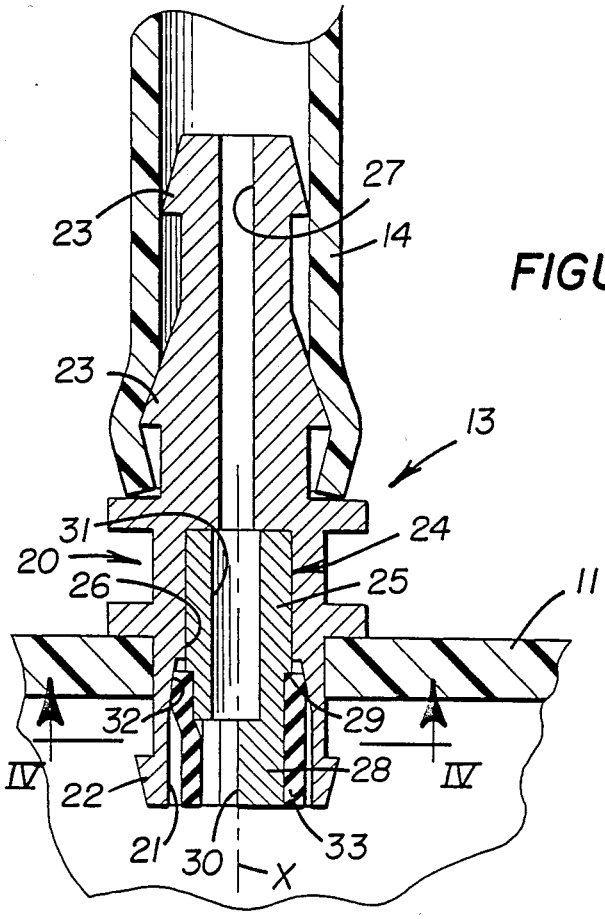
FIG. 3 is a longitudinal sectional view of the control valve, generally taken in the direction of arrows III—III in FIG. 1.

Micro flow control valve 13 further comprises a body element, shown in the form of a generally cylindrical pin 24. The pin has a cylindrical first body portion 25 adapted to be slip-fit within a bore 26 of housing 20 which is connected to the counter bore defining inlet chamber 21. Bore 26 further communicates with a cylindrical passage 27, also disposed on a longitudinal axis X of the housing and integrated control valve (FIG. 3).

Pin 24 further comprises a partially cylindrical second body portion 28 defining a radial shoulder 29 on the downstream end of first body portion 25, between body portions 25 and 28. An open-top channel 30 is defined at an outer surface of body portion 28 to preferably extend the full length thereof, as shown. The channel communicates directly with an internal flow passage 31, formed centrally in the pin to further communicate with passage 27. It should be noted that the downstream end of inlet chamber 21 terminates at a frusto-conically shaped wall 32, intersecting bore 26.

Micro flow control valve 13 further comprises an elastomeric flexible diaphragm 33 stretched over and mounted (elastically clamped) on body portion 28 of the pin to at least partially cover channel 30 on the outer surface of the pin. The upstream end of the diaphragm engages shoulder 29, which functions as a stop, and is wedged and compressed in clamped relationship between pin 24 and wall 32 of housing 20 to releasably "lock" the pin in position. This feature ensures that the diaphragm will not become dislodged from the unitized pin when a negative vacuum occurs in main water line 11, such as when the line is drained.

As described more fully hereinafter, when main line water pressure is communicated to inlet chamber 21 in surrounding relationship about the diaphragm, portions of the diaphragm covering channel 30 will flex into and cooperate with the channel to maintain the flow rate of water in flow passage 31 and at outlet 27 of the control valve at a predetermined near constant micro flow rate in despite the variable water pressure prevalent in the inlet chamber. In particular, a differential in water pressure is produced between the inlet chamber and channel (on opposite sides of diaphragm 33) to maintain the precalculated near constant micro flow rate in this manner.

As used herein, the term "micro flow rate" means a flow rate of water selected from within the approximate overall maximum range of from 2.0 gph to 60.0 gph and more commonly from within the range of from 2.0 gph to 30.0 gph. The term "near constant micro flow rate" means a preselected flow rate for a particular micro flow control valve that will be approximated when the control valve is placed in operation. For example, in Table I, infra, "2 GPH" under the "Near Micro Flow Rate" column designates a manufacturer's (Wade Manufacturing Co. of Fresno, Calif.) number for a micro flow control valve that will maintain a flow rate in the pretested range of from 2.09 gph to 2.66 gph when the level of water pressure prevalent in inlet chamber 21 fluctuates between 10 psi and 60 psi. The various micro flow control valves listed can be numerically and/or color coded to indicate their various manufacturer-designated "Near Micro Flow Rate" ratings.

Diaphragm 33 is formed from an elastomeric tubing exhibiting sufficient flexibility and related physical characteristics (e.g., durometer hardness in the approximate range of from 40–45) to provide the functional desiderata herein described. For example, the tubing may comprise a non-degradable natural rubber, synthetic rubber, silicone rubber or the like. Silicone rubber tubing, having a wall thickness in the approximate range of from 0.020 in. to 0.040 in., has proven acceptable and was used for the tests set forth in Tables I and II, infra. When assembled, the inside diameter of the tubing is slightly less than the outside diameter of pin body portion 28 to permit the tube to be stretched over and elastically clamped onto the pin.

Figure 4:
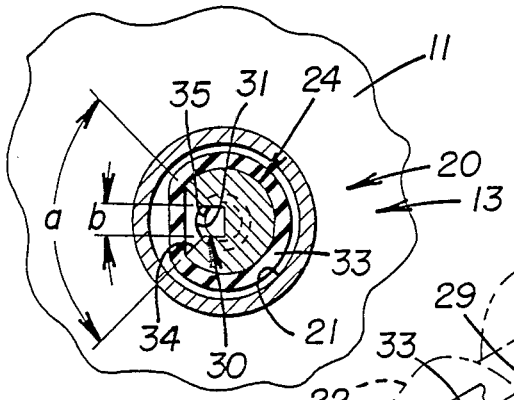
FIG. 4 is a cross-sectional view through the control valve, taken in the direction of IV—IV in FIG. 3.
Figure 5:
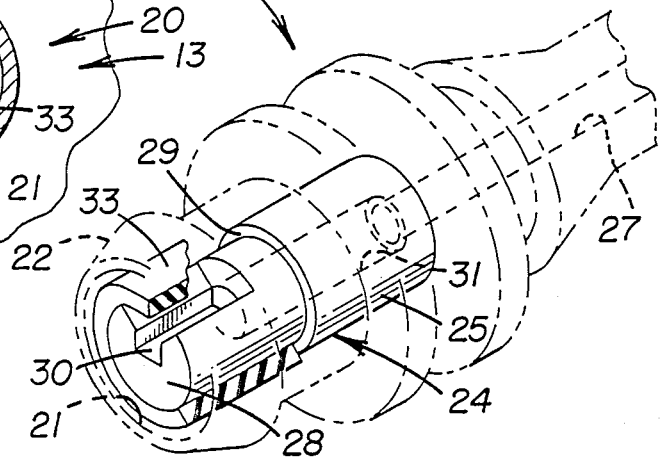
FIG. 5 is an isometric view of a pin employed in the control valve.

Referring to FIGS. 4 and 5, channel 30 is defined by a pair of converging and opposed first wall sections 34 extending inwardly from the outer surface of pin 24 to define an included first angle "a" therebetween, preferably selected from the approximate range of from 80° to 160° and more preferably within the range of from 106° to 156°. A pair of converging and opposed second wall sections 35 intersect and extend inwardly from the first wall sections to define a included acute second angle "b" therebetween, preferably selected from the approximate range of from 0° (FIG. 4) to 60°.

FIGS. 6–10 are views similar to FIG. 4, but illustrate modifications of channel 30. Identical numerals depict corresponding constructions.

In FIG. 6, a modified channel **30*a* comprises first wall sections 34*a* extending inwardly at included angle "a" from the outer surface of a modified pin 24*a* to intersect a pair of converging second wall sections 35*a*, defining an included acute angle "b" therebetween approximating 30°. In FIG. 7, a channel 30*b* of a modified pin 24*b* comprises a pair of third wall sections 36 defining an included third angle c therebetween of 0°, and which may be selected from the range of from 0° to 60°, depending on the selection of larger angles "a" and "b". It should be noted that the multiple pairs of wall sections defining each channel 30 (FIG. 4), 30*a* (FIG. 6) and 30*b* (FIG. 7**) are defined by included angles therebetween that are progressively smaller, inwardly from the outer surface of the respective pin towards the center thereof.

FIG. 8 illustrates a modified pin **24*c* formed with an arcuate channel 30*c***, shown in the form of a semicircle.

FIG. 9 illustrates a pin 24c' formed with a pair of circumferentially disposed and diametrically opposed arcuate channels 30c', connected to outlet flow passage 31 by a radial cross-passage 37. In FIG. 10, a pin 24c'' is formed with two pairs of diametrically opposed channels 30c'', connected to flow passage 31 by cross-passages 37' and 38. It should be understood that pins 24, 24a and 24b could also be formed with multiple channels. Multiple channels are normally used for micro flow control valves employed in irrigation systems designed to operate under main line working pressures approximating 10 psi and less.

Following Tables I and II depict test results and design parameters (each channel approximated 0.150 in. in length) for the FIGS. 4 and 5 micro flow control valves, each of which was found to maintain a predetermined near constant micro flow rate of water from the outlet thereof despite fluctuations in water pressure (10 psi–60 psi) communicated to the inlets of the control valves.

TABLE I

| INLET WATER PRESSURE/OUTLET FLOW RATE | | | | | | | | |
|---|---|---|---|---|---|---|---|---|
| Near Micro Flow Flow Rate | 10 PSI | 15 PSI | 20 PSI | 25 PSI | 30 PSI | 40 PSI | 50 PSI | 60 PSI |
| 2 GPH | 2.09 | 2.22 | 2.34 | 2.53 | 2.53 | 2.66 | 2.53 | 2.53 |
| 3 GPH | 3.17 | 3.30 | 3.49 | 3.49 | 3.49 | 3.74 | 3.74 | 3.49 |
| 5 GPH | 5.07 | 5.40 | 5.58 | 5.58 | 5.70 | 5.58 | 5.40 | 5.07 |
| 7 GPH | 6.67 | 6.98 | 6.67 | 6.98 | 6.67 | 6.67 | 6.34 | 6.34 |
| 10 GPH | 8.25 | 9.84 | 10.48 | 10.48 | 10.79 | 10.79 | 10.48 | 10.48 |
| 15 GPH | — | — | 14.60 | 15.55 | 16.50 | 16.50 | 15.55 | 15.55 |
| 20 GPH | — | — | 18.41 | 19.68 | 20.31 | 20.31 | 20.95 | 21.26 |

TABLE II

| Near Micro Flow Rate | Figure Showing Channel Cross-Section | Angle (b) of Lower Wall Sections | Angle (a) of Upper Wall Sections | Width of Channel Floor (In.) | Height of Lower Wall Section (In.) | Depth of Channel (In.) |
|---|---|---|---|---|---|---|
| 2 GPH | 4 | 0° | 78° | .025 | .008 | .047 |
| 3 GPH | 4 | 0° | 75° | .030 | .019 | .053 |
| 5 GPH | 4 | 0° | 65° | .030 | .017 | .065 |
| 7 GPH | 4 | 0° | 64° | .031 | .025 | .071 |
| 10 GPH | 4 | 0° | 58° | .031 | .030 | .080 |
| 15 GPH | 6 | 30° | 57° | .010 | .075 | .106 |
| 20 GPH | 6 | 20° | 53° | .020 | .070 | .115 |

As described above, the micro flow control valve of the present invention functions in response to the pressure differential occurring between the outer and inner surfaces of the flexible diaphragm. The outer surface of the diaphragm is exposed to main line water pressure (10 psi to 60 psi) whereas the inner surface thereof is exposed to pressure resulting from restricted water flow through the channel of the pin. The inner surface of the diaphragm rests in intimate contact on the solid surface of the pin and bridges across the top of the respective channels in the manner illustrated.

Assuming zero flow of water through the channel, the pressure on the outer and inner surfaces of the diaphragm would be equal and the stretched portions of the diaphragm covering the channel would remain static. However, when water flows through the channel, a pressure drop will occur at the outlet of the channel under well-known principles. As a result of this pressure drop, a variable pressure differential will be produced between the outer and inner surfaces of the diaphragm, to flex the membrane down into and out of the channel to control water flow therethrough. When the system is initially pressurized with water, the channel will be fully open to purge the valve and lines of foreign particles, i.e., the system is self-purging.

The above teachings will enable those skilled in the art to pre-calculate and design micro flow control valves suitable for a wide range of irrigation applications. The dimensional parameters of channel 33, the dimensional parameters and physical properties (durometer hardness, modulus of elasticity, bulk modulus, etc.), the dimensional parameters of the various flow passages and chamber 34, and related design parameters will dictate the functional design requirements for a particular micro flow control valve.

One of the features of this invention is the ability of a gardener to selectively change the near constant micro flow rate of water in an irrigation system, communicated to a water distributing device. In particular, a particular micro flow control valve (FIG. 1) can be selectively removed from main line 11 and replaced by a second substitute control valve having a flow rate characteristics different from that of the replaced control valve to maintain a predetermined near constant second micro flow rate at the outlet of the substitute control valve. Alternatively, only unitized pin 24 and pin 33 can be replaced to provide such second micro flow rate.

I claim:

1. In an irrigation system comprising a flow control valve means having an outlet connected to a water distributing device for maintaining a predetermined near constant flow rate of water thereto despite fluctuations in water pressure communicated to an inlet to said valve means, said valve means comprising a housing having a cylindrical inner wall defining a water-receiving chamber at the inlet to said valve means adapted to receive water therein at a working pressure level within the approximate range of from 10 psi to 60 psi, a body, element removably mounted in slip-fit relationship within said chamber and having a longitudinal axis, at least one channel means defined within said body element for intercommunicating said inlet and outlet and extending in the direction of said axis, said channel means being defined by a pair of converging and opposed first wall sections extending inwardly toward said axis to define an included first angle therebetween and a pair of opposed second wall sections intersecting and extending inwardly towards said axis from said first wall sections to define an included second angle therebetween that is less than said first angle, and flexible diaphragm means formed solely as a unitized part of said removably mounted body element and at least partially covering said channel means for flexing into and cooperating with said channel means to maintain the flow rate of water at said outlet at said predetermined near constant flow rate in response to a differential in water pressure produced between said chamber and said channel means, said flexible diaphragm means spaced radially inwardly from the inner wall of said housing to define substantial outer surface portions thereon entirely fixed to said body element in bridging relationship across said channel means and directly exposed to water communicated to said chamber from said inlet.

2. The irrigation system of claim 1 wherein the flow rate overall maximum range is from 2.0 gph to 30 gph.

3. The irrigation system of claim 1 wherein said first angle is selected from the approximate range of from 80° to 160° and said second angle is selected from the approximate range of from 0° to 60°.

4. The irrigation system of claim 3 wherein said first angle is selected from the range of from 106° to 156°.

5. The irrigation system of claim 1 wherein said channel means is further defined by a pair of opposed third wall sections intersecting and extending inwardly from said second wall sections.

6. The irrigation system of claim 1 wherein said channel means has an arcuate cross-section.

7. The irrigation system of claim 1 wherein a plurality of said channel means are defined in circumferentially spaced relationship within said body element.

8. The irrigation system of claim 7 wherein a pair of said channel means are defined in diametrically opposed relationship within said body element.

9. The irrigation system of claim 8 wherein two pairs of said pair of said channel means are defined within of said body element.

10. The irrigation system of claim 1 wherein said housing comprises a bore connected to said chamber and said body element comprises a first body portion disposed in slip-fit relationship within said bore and a second body portion, having said channel means defined therein, disposed in said chamber, and a flow passage formed centrally in said first body portion, along with said axis to communicate said channel means with said outlet.

11. The irrigation system of claim 10 wherein said housing further comprises a frusto-conically shaped wall interconnected between said bore and said chamber to converge towards said bore, a portion of said diaphragm means adjacent to said bore wedged and compressed in clamped relationship between said wall and said body element.

12. The irrigation system of claim 11 further comprising an annular shoulder defined between the first and second body portions of said body element and wherein an end of said diaphragm means engages said shoulder.

13. The irrigation system of claim 1 wherein said diaphragm means comprises an elastomeric tube stretched-over and frictionally coupled onto said body element.

14. The flow control valve of claim 9 further comprising a housing defining a water receiving inlet chamber means for receiving said water therein and wherein said body element is disposed in said inlet chamber means to expose said diaphragm means to such water.

15. A flow control valve adapted for use in an irrigation system to maintain a predetermined near constant flow rate of water, communicated to a water distributing device, said control valve comprising, a body element having an inlet and an outlet and disposed on a longitudinal axis thereof, at least one open-top channel means defined within said body element for intercommunicating said inlet and outlet and extending in the direction of said axis, said channel means being defined by a pair of converging and opposed first wall sections extending inwardly toward said axis to define an included first angle therebetween and a pair of opposed second wall sections intersecting and extending inwardly towards said axis from said first wall sections to define an included second angle therebetween that is less than said first angle, and flexible diaphragm means formed solely as a unitized part of said body element and at least partially covering said channel means for flexing into and cooperating with said channel means to maintain the flow rate of water at said outlet at said predetermined near constant flow rate in response to a differential in water pressure produced between said channel means and externally on said diaphragm means, said flexible diaphragm means defining an at least generally flat outer surface thereon entirely fixed to said body element in bridging relationship across said channel means and adapted to be directly exposed to water communicated to said inlet, when viewed in cross-section said outer surface at least generally defining a chord of a circle that subscribes an outer circumference of said control valve thereat.

16. The control valve of claim 15 wherein the flow rate overall maximum range is from 2.0 gph to 30 gph.

17. The control valve of claim 15 wherein said first angle is selected from the approximate range of from 80° to 160° and said second angle is selected from the approximate range of from 0° to 60°.

18. The control valve of claim 17 wherein said first angle is selected from the range of from 106° to 156°.

19. The control valve of claim 15 wherein said channel means is further defined by a pair of opposed third wall sections intersecting and extending inwardly from said second wall sections.

20. The control valve of claim 15 wherein said channel means has an arcuate cross-section.

21. The control valve of claim 15 wherein a plurality of said channel means are defined in circumferentially spaced relationship within said body element.

22. The control valve of claim 21 wherein a pair of said channel means are defined in diametrically opposed relationship within said body element.

23. The control valve of claim 22 wherein two pairs of said pair of said channel means are defined within said body element.

24. The control valve of claim 14 wherein said housing comprises a bore connected to said chamber means and said body element comprises a first body portion disposed in slip-fit relationship within said bore and a second body portion, having said channel means defined therein, disposed in said chamber means, and a flow passage formed centrally in said first body portion, along said axis, to communicate said channel means with said outlet.

25. The control valve of claim 24 wherein said housing further comprises a frusto-conically shaped wall interconnected between said bore and said chamber and to converge towards said bore, a portion of said diaphragm means adjacent to said bore wedged and compressed in clamped relationship between said wall and said body element.

26. The control valve of claim 24 wherein an annular shoulder is defined between the first and second body portions of said body element and an end of said diaphragm means is engaged against said shoulder.

27. The control valve of claim 15 wherein said diaphragm means comprises an elastomeric tube stretched-over and frictionally coupled onto said body element.

28. A flow control valve adapted for use in an irrigation system to maintain a predetermined near constant micro flow rate of water communicated to a water distributing device, said control valve comprising, a body element having an inlet and an outlet and disposed on a longitudinal axis thereof, at least one channel means defined at an outer surface of said body element for intercommunicating said inlet and outlet and extending in the direction of said axis, said channel means being defined by a pair of converging and opposed first wall sections extending inwardly from said outer surface towards said axis to define an included first angle therebetween and a pair of opposed second wall sections intersecting and extending inwardly towards said axis from said first wall sections to define an included second angle therebetween that is less than said first angle, and flexible diaphragm means formed solely as a unitized part of said body element and at least partially covering said channel means for flexing into and cooperating with said channel means to maintain the flow rate of water at said outlet at said predetermined near constant flow rate in response to a differential in water pressure produced between said channel and externally on said diaphragm means.

* * * * *